US010641436B2

(12) United States Patent
He et al.

(10) Patent No.: US 10,641,436 B2
(45) Date of Patent: May 5, 2020

(54) LED LAMP FOR REPLACING A FLUORESCENT TUBE LAMP

(71) Applicant: LEDVANCE GmbH, Garching bei Munchen (DE)

(72) Inventors: Xiongqiang He, Guangdong (CN); Jianjian Huang, Guangdong (CN)

(73) Assignee: LEDVANCE GMBH, Garching Bei Munchen (DE)

( * ) Notice: Subject to any disclaimer, the term of this patent is extended or adjusted under 35 U.S.C. 154(b) by 0 days.

(21) Appl. No.: 16/377,544

(22) Filed: Apr. 8, 2019

(65) Prior Publication Data

US 2019/0309910 A1 Oct. 10, 2019

(30) Foreign Application Priority Data

Apr. 8, 2018 (CN) ..... 2018 1 030604

(51) Int. Cl.
*F21K 9/275* (2016.01)
*H05B 33/08* (2020.01)
*F21V 25/04* (2006.01)

(52) U.S. Cl.
CPC ..... *F21K 9/275* (2016.08); *F21V 25/04* (2013.01); *H05B 33/0806* (2013.01)

(58) Field of Classification Search
CPC ..... F21K 9/00; F21K 9/20; F21K 9/27; F21K 9/275; F21V 25/00; F21V 25/02; F21V 25/04; H05B 33/02; H05B 33/08; H05B 33/0803; H05B 33/0806
See application file for complete search history.

(56) References Cited

U.S. PATENT DOCUMENTS

| | | | | |
|---|---|---|---|---|
| 9,328,874 | B2 * | 5/2016 | Demuynck | F21V 23/06 |
| 9,388,948 | B2 * | 7/2016 | Demuynck | F21K 9/278 |
| 9,420,663 | B1 * | 8/2016 | Hsia | H02M 1/32 |
| 9,557,044 | B2 * | 1/2017 | Davenport | F21V 25/00 |
| 2010/0201239 | A1 * | 8/2010 | Mostoller | F21S 8/031 313/1 |
| 2011/0019398 | A1 * | 1/2011 | Bishop | H05K 1/142 362/225 |
| 2011/0260614 | A1 | 10/2011 | Hartikka et al. | |
| 2011/0286225 | A1 * | 11/2011 | Konishi | F21V 19/0085 362/398 |
| 2012/0106157 | A1 * | 5/2012 | Simon | F21V 25/04 362/249.05 |
| 2012/0153873 | A1 * | 6/2012 | Hayashi | F21V 23/06 315/313 |

(Continued)

*Primary Examiner* — Jason Crawford
(74) *Attorney, Agent, or Firm* — Hayes Soloway PC

(57) ABSTRACT

A disconnector for an electric circuit having a first electrical contact and a second electrical contact for connecting or disconnecting an electric circuit connected to the first electrical contact and the second electrical contact. Each of the contacts have a first end with a base contact and a second end with a contact point for electrically connecting the first electrical contact to the second electrical contact. The disconnector has a isolating support for supporting the first electrical contact and the second electrical contact such that the first electrical contact is in touch with the second electrical contact at the contact points in a mechanically pre-loaded condition to connect the electric circuit electrically. The first electrical contact and the second electrical contact can be separated by a separator plate.

20 Claims, 4 Drawing Sheets

(56) References Cited

U.S. PATENT DOCUMENTS

| | | | | |
|---|---|---|---|---|
| 2012/0212951 | A1* | 8/2012 | Lai | F21V 23/002 362/218 |
| 2012/0300445 | A1* | 11/2012 | Chu | F21V 25/04 362/217.13 |
| 2013/0093309 | A1* | 4/2013 | Deppe | F21V 25/04 313/51 |
| 2013/0127327 | A1* | 5/2013 | Heil | F21V 25/04 313/313 |
| 2013/0241443 | A1* | 9/2013 | Ozguc | F21V 25/04 315/362 |
| 2014/0104828 | A1* | 4/2014 | Wei | F21V 19/0045 362/223 |
| 2014/0355261 | A1* | 12/2014 | Dingemans | F21V 25/04 362/217.17 |
| 2015/0176770 | A1* | 6/2015 | Wilcox | F21K 9/90 362/224 |
| 2015/0176771 | A1* | 6/2015 | Lin | H01R 33/08 439/226 |
| 2015/0364886 | A1* | 12/2015 | Jansen | F21K 9/272 362/221 |
| 2016/0219672 | A1* | 7/2016 | Liu | F21K 9/27 |
| 2016/0290606 | A1* | 10/2016 | Honold | F21V 25/04 |
| 2016/0327216 | A1* | 11/2016 | Gielen | F21K 9/27 |
| 2017/0023186 | A1* | 1/2017 | Norton | F21K 9/90 |
| 2018/0038556 | A1* | 2/2018 | Zhao | F21K 9/272 |
| 2018/0100626 | A1* | 4/2018 | Minter | F21V 15/015 |

* cited by examiner

LED LAMP FOR REPLACING A FLUORESCENT TUBE LAMP

CROSS-REFERENCE

This patent application claims priority from Chinese Patent Application No. 201810306045.X filed Apr. 8, 2018, which is herein incorporated by reference in its entirety.

TECHNICAL FIELD

The present invention relates to a disconnector device for a retrofitting LED lamp for replacing a conventional fluorescent tube.

BACKGROUND

Conventional fluorescent tubes used in conventional luminaire housings have a straight, crescent or circular body with a maximum length of 2400 mm of the tube. Fluorescent tubes normally are low-pressure discharge lamps having a coating on the inner surface comprising a fluorescent material such as phosphor. The fluorescent tube lamp typically comprises an air-tight glass tube, a fill of inert gas, and electrodes. At each end of the fluorescent tube, there is a lid with two symmetrically positioned contact pins, to which the electrodes are connected. Electric power supply is provided to the fluorescent tube via these two contact pins.

Replacing a fluorescent tube, e.g. for the purpose of energy saving, with a retrofitting LED lamp (afterwards LED lamp), is becoming common nowadays. Retrofitting is understood to mean replacing a fluorescent tube by a LED lamp without altering the luminaire housing of the fluorescent tube. The luminaire housing comprises a base, at least two tube holders as well as the electronic devices necessary for operating the fluorescent tube. Changing the fluorescent tube may not include the optional requirement of removing or replacing the starter or a load or ballast by something else.

When replacing a fluorescent tube with a LED lamp, an issue related to the threatening of an electric shock during the assembly process of the LED lamp can occur. According to the safety regulations in the field of electricity, luminaire housings are constructed such that when a fluorescent tube is replaced, it is not possible to touch any voltage-carrying parts even if the fluorescent tube housing is not disconnected.

This requirement has also to be adhered even if the fluorescence tube is replaced in such a way that only one end of the tube is in contact with the contacts of a tube holder of the luminaire housing so that the person replacing the tube can touch the other end of the tube. This requirement is met automatically with a fluorescent tube because no current flows through the gas-filled fluorescent tube before the gas in the tube is ionized by a voltage pulse. This starting pulse is generated by a so called ballast. In other words, unless being ionized, the gas in the fluorescent tube is nonconductive. Thus, the electric structure of the luminaire housing is such that the generation of a starting pulse is required to electrically connect both ends of the fluorescent tube to each other. Hence, the fluorescent tube prevents the risk of an electric shock during replacement by means of constructive measures.

With LED lamps, this electric safety requirement is not automatically met. LED lamps usually comprise a printed circuit board or a corresponding structure, on which LEDs and other electronic components and drivers such as driver devices for the LEDs are mounted. The purpose of the components is to convert the alternating voltage of the power supply into direct voltage and to control the directed current required by the LEDs. In practice, if one end of the LED lamp is connected to the tube holder of the luminaire housing the LED lamp is energized. In other words, the LED lamp may always be in a conductive state without having been supplied with a starting pulse by the ballast. Therefore, when the LED lamp is being mounted on fluorescent luminaire housings, the contact pins at one end of the LED lamp may be connected to the contacts of one tube holder of the fluorescent luminaire housing while the other end of the LED lamp may still remain outside the fluorescent luminaire housing. In consequence, a person mounting or replacing the LED lamp may touch the free pins of the LED lamp which are under voltage.

US 2011/0260614 discloses a LED lamp for replacing a fluorescent tube. The LED lamp comprises a safety unit to prevent a voltage from transferring through the LED lamp from its one end to the other end until a voltage supplied from a corresponding tube holder of the luminaire housing to the pair of contact pins has been separately detected at each end of the LED lamp. Inside the LED lamp, there is at least one optical line that is arranged to transfer a control or measurement signal associated with the safety unit from one end of the LED lamp to the other without capacitive leakage currents. However, the safety unit is expensive and may itself show a malfunction causing an electric shock.

SUMMARY OF THE INVENTION

In view of the known prior art, it is an object of the present invention to provide a simple and inexpensive solution to prevent an electric shock when replacing a LED lamp in a luminaire housing of a conventional fluorescent tube.

This object is solved by a LED lamp with a disconnector device according to the independent claim as well as a method for replacing a fluorescent tube lamp by a LED lamp. The LED lamp with such a disconnector is easily manufactured and has low production costs per unit. Preferred embodiments are given by the dependent claims, the specification as well as the figures.

The LED lamp comprises a transparent tube including an LED lighting module, a first contact pin at a first end of the tube and a second contact pin at a second end of the tube for connecting the LED lamp electrically and mechanically to an luminaire housing, wherein the first contact pin and the second contact pin form an electric circuitry with an LED driver for driving the LED lighting module. A disconnector is arranged in the electric circuitry between the first pin and the second pin for disconnecting the first pin from the second pin during installation of the LED lamp.

The first pin and/or the second pin can also be present as a pair of pins each as in the form factor of conventional fluorescent tubes.

The disconnector may comprise a first electric contact and a second electric contact which are hereafter also described as first contact and second contact. Each of the contacts may have a base contact at a first end and a contact point at a second end. The base contact of the contacts is for assembling the contacts to a support or directly to a circuit board and preferably for electrical contacting the contacts to an electric circuit via a circuit board or a wire. The contact point is for connecting the first contact electrically to the second contact in order to close the electrical circuitry between the first pin and the second pin. The electrical connection between the first contact and the second contact is detachable. Detachable is intended to mean that the first contact can be electrically separated from the second contact.

The support can be a mounting bracket or a circuit board. The support can be isolating in parts or as a whole. Each of the contacts may also have protrusion which may be connected to the support by overmolding or by a snap-on connection.

Isolating is understood in here to refer to a non-conducting arrangement which does not conduct electricity in an amount that would be harmful to an individual. This does not necessarily mean that the isolating parts do fully isolate such that no current at all is conducted but the isolation is at least such that the function of preventing the harmful conduction of a current is achieved.

The first contact and the second contact may be firmly attached to the support at their first ends or at a position between the first end and the second ends of the respective contact such that the first contact is in touch with the second contact at their second ends respectively the contact points in a mechanically pre-loaded condition. Thus, an electric circuit which is connected to the first contact and the second contact is electrically closed or connected.

The contact resistance between the first contact and the second contact depends on the contact force and declines with a rising contact fore at the contact points between the first contact and the second contact. In a preferred embodiment the first and the second electric contact may be flexible spring contacts.

A spring contact may be a die-cut or stamped piece from a continuous strip of metal which consequently underwent mechanical bending to achieve the desired spring shape. These two manufacturing stages are performed either seamlessly, using a progressive tool, or individually, with the help of separate stamping and bending tools. Preferably each of the contacts designed as spring contact or parts thereof may have a shape similar to one of the characters "c" or "u" but can have any other shape too.

The shape of the contact spring is responsible for the spring rate which means contact force and spring deflection. Each spring contact may designed as a one-piece or as a multi-part device with for example an additional support spring. In a preferred embodiment the second end of the contacts have the shape of the character "u" with a bending portion for the generation of a spring force by getting the first electrical contact in touch with the second electrical contact at the contact points.

In a preferred embodiment the contacts are made of a bronze material. Bronze is an alloy that consists primarily of copper with the addition of other ingredients. In most cases one ingredient added is typically tin, arsenic, phosphorus, aluminum, manganese, and silicon can also be used to produce different properties in the material. All of these ingredients produce an alloy much harder than copper alone. Preferred embodiments for materials are CuFe2P, CuZn36, CuNi18Zn20, CuSn6, CuNi9Sn2, CuNi20Mn20, CuTi2, CuZn23AlCo as well as CuBe2.

In a preferred embodiment a beryllium copper alloy can be used. Such an alloy is a material that offers excellent spring characteristics in combination with a high material strength. Further advantages are corrosion resistance and self-cleaning behavior of the contacts by opening and closing. The contact spring can also be made out of steel. The contact springs may also be plated with gold, silver, tin, tungsten or nickel or can be an alloy thereof.

The isolating support for the contacts can be made out of a material like plastic, ceramic or a sinter material by injection molding, a pressing process or a sinter process.

The support may have a cube shape with a seat for a separator plate for separating the first contact and the second contact to disconnect the electric circuit which may be connected to the contacts. The seat may be a grove which may be bell-mouthed. Bell-mouthed is intended to mean a tapered expanding or reducing opening. For separating the first contact from the second contact the separator plate can be tensioned between the first contact and the second contact of the disconnector.

The separator plate may be longer than wide and may have an approximately rectangular shape. The separator plate is made from an insulating respectively isolating material. Insulating materials have a conductivity in the range from $10^{-8}$ to $10^{-26}$ $Scm^{-1}$. The separator plate has a flat design according to the thickness. Furthermore it has an upper part according to the longitudinal side which may be designed as holder for gripping the separator plate by hand and a bottom part for separating the first contact from the second contact. For this purpose, the bottom part can be tensioned between the first contact and the second contact of the disconnector to separate the first contact mechanically from the second contact. Thus, the electric circuit will be disconnected. The separator plate may have two additional protrusions for limiting the insertion depth of the separator plate into an opening of an end cap. The separator plate may be at the longitudinal side or on the broad side. The separator plate may have an additional cut-out at the bottom part.

The first as well as the second pin can respectively be supported by an end cap of the LED lamp on the first and the second end of the tube. The tube itself can be made out of glass or plastic, surrounding the longitudinal side of the LED lamp.

The end cap can be firmly attached to the tube itself or via a fastener. The LED lamp may further comprise some electronic devices which can be part of an LED driver supplying several LED lighting module respectively an array of LED lighting module. The first pin may be connected to the first contact of the disconnector via a circuit board or a wire. The disconnector can be firmly attached to the circuit board. The second contact of the disconnector can be connected to the electronic devices via the circuit board or a wire.

The end cap may have an opening for inserting the separator plate for disconnecting the first contact from the second contact by tensioning the separator plate between the first contact and the second contact of the disconnector for disconnecting the electric path between the first pin and the electronic devices via the disconnector for example to replace an LED lamp in case of a defect.

Alternatively the separator plate can be removed for connecting the first electrical contact and the second electrical contact in order to connect the electric path between the first pin and the electronic devices via the disconnector.

The size of the opening of the end cap may correspond to the size of the bottom part of the separation plate such that the insertion depth of the separation plate can be limited by the protrusions of the separation plate.

The invention further provides a method for replacing a conventional fluorescence tube by a LED.

The method for replacing a conventional fluorescence tube by an LED lamp comprises the steps of removing the conventional fluorescence tube from a luminaire housing, then inserting the LED lamp with a first pin at a first end of the tube to a first tube holder and with a second pin at a second end of the tube to a second tube holder, and connecting the electrical circuitry between the first pin and the second pin by closing the disconnector after insertion of the LED lamp into the first and second tube holders.

Closing the disconnector may be achieved by removing a separator plate from the LED lamp for connecting the first contact of the disconnector to the second contact of the disconnector.

BRIEF DESCRIPTION OF THE DRAWINGS

Preferred embodiments of the invention will be explained in the following, having regard to the drawings. It is shown in.

DETAILED DESCRIPTION OF THE INVENTION

In the following, preferred embodiments of the invention will be described with reference to the drawings. The same or similar elements or elements having the same effect may be indicated by the same reference number in multiple drawings. Repeating the description of such elements may be omitted in order to prevent redundant descriptions.

Figure 1:
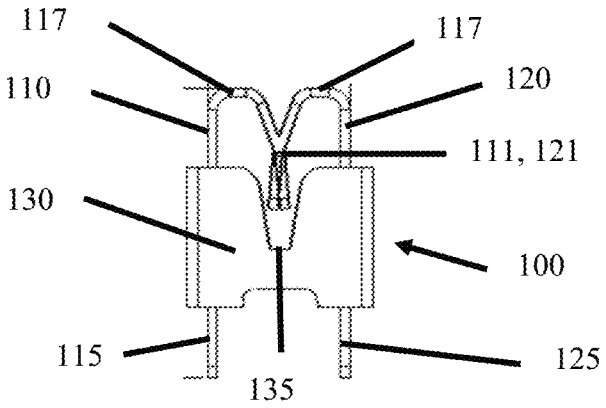
FIG. 1 shows a sectional view of a first embodiment of the disconnector.

FIG. 1 shows a sectional view of a disconnector 100 which is to be used in the LED lamp of the present disclosure in an electrically closed condition. The disconnector 100 comprises a first electric contact 110 and a second electric contact 120 touching each other in a contact point 111, 121. The first electric contact 110 and the second electric contact 120 are firmly attached to a support 130. Each of the contacts 110, 120 has a contact base 115, 125 for connecting the contacts 110, 120 to an electric circuit.

Figure 2:
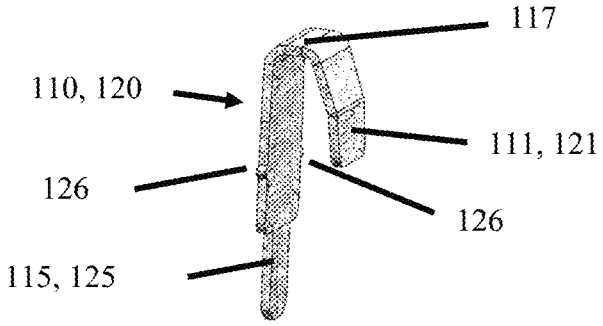
FIG. 2 shows a perspective view of a first or second contact designed as spring contact.

FIG. 2 shows an electric first respectively second contact 110, 120 of the disconnector 100 in detail. The contacts 110, 120 are designed as contact springs which are flexible. Each contact spring has a base contact 115, 125 at a first end of the contact 110, 120 and a contact point 111, 121 at a second end of the contact 110, 120. The contact points 111, 121 can be placed in touch with each other in order to close an electric circuit. Each contact 110, 120 has a bending portion 117 similar to an "u" shape to generate a spring force by pressing the first contact 110 against the second contact 120 at the contact points 111, 121. The contact resistance between the first contact 110 and the second contact 120 depends on the force at the contact points 111, 121. The contacts 110, 120 have protrusion 126 which may be connected to the support 130 by overmolding or a snap-on connection.

Figure 3:
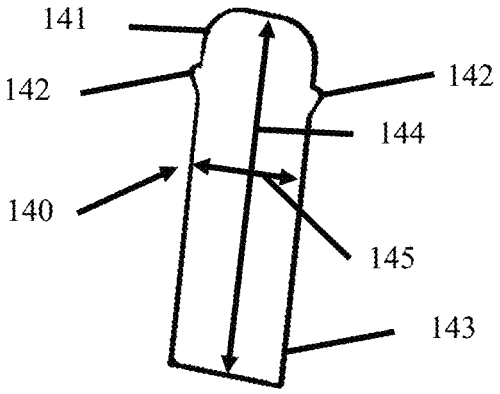
FIG. 3 shows a first embodiment of a separator plate for disconnecting the first contact and the second contact.

FIG. 3 shows a separator plate 140. The separator plate 140 is longer 144 than wide and 145 may have an approximately rectangular shape. The separator plate 140 has a flat design and has an upper part 141 designed as holder for gripping the separator plate 140 by hand and a bottom part 143 for separating the first contact 110 from the second contact 120.

For this purpose, the bottom part 143 is tensioned between the first contact 110 and the second contact 120 of the disconnector 100 to separate the first contact 110 from the second contact 120. Thus, the electric circuit will be disconnected. The separator plate 140 may have two additional protrusions 142 for limiting the insertion depth of the separator plate 140 into an opening 285 of an end cap 225.

Figure 4:
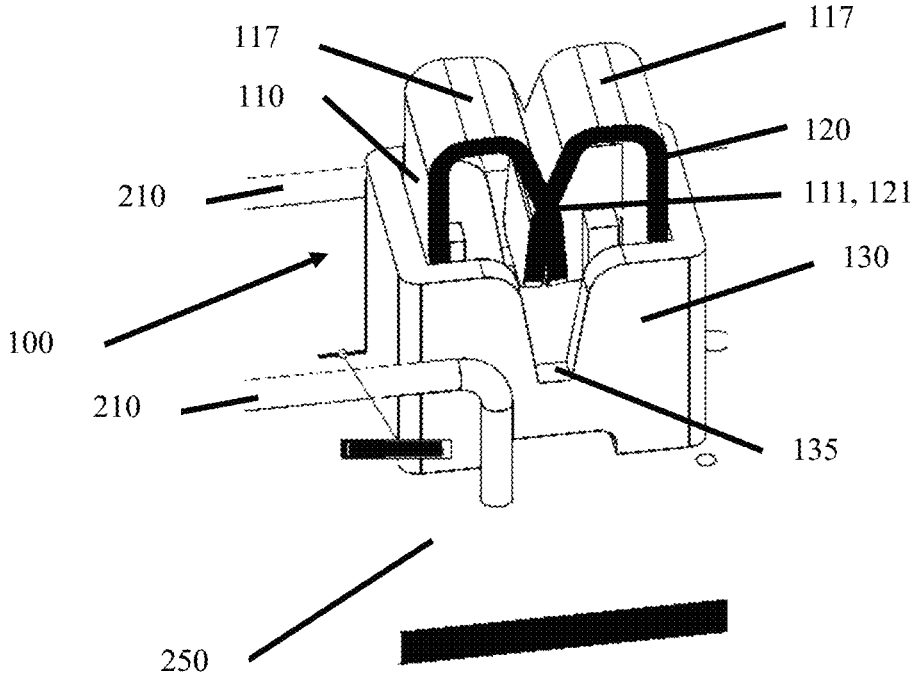
FIG. 4 shows a perspective view of the disconnector assembled on a circuit board.

FIG. 4 shows the inventive disconnector 100 in electrically closed condition assembled on a circuit board 250. The first contact 110 is connected to a first pair of pins 210 and via the contact points 111, 121 to the second contact 120. The first contact 110 and the second contact 120 are in a mechanically preloaded state by pressing against each other at the contact points 111, 121. The spring force will be generated by the bending portion 117.

The support 130 has a cube shape with a seat 135 for a separator plate 140 for separating the first contact 110 and the second contact 120 to disconnect the electric circuit which may be connected to the contacts 110, 120. The seat 135 has a bell-mouthed shape. Bell-mouthed means a tapered expanding opening. For separating the first contact 110 from the second contact 120, the separator plate 140 can be placed between the first contact 110 and the second contact 120 of the disconnector 100.

Figure 5:
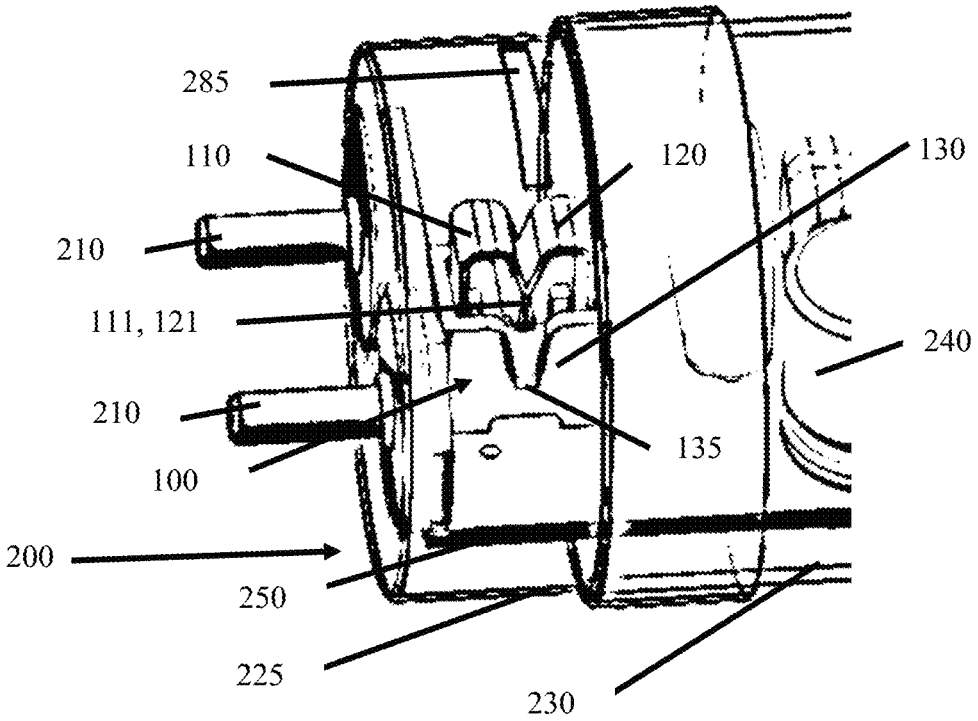
FIG. 5 shows a perspective view of a first embodiment of the disconnector in a closed condition used in an LED lamp.

FIG. 5 shows a sectional view of a LED lamp 200 with the inventive use of the disconnector 100 in an electrically closed condition. The LED lamp 200 comprising a first pair of pins 210 supported by an end cap 225 of the LED lamp 200. A tube 230 may be made out of glass or plastic surrounding the longitudinal side of the LED lamp 200.

The end cap 225 is firmly attached to the tube 230. The LED lamp 200 may further comprise some electronic devices 240. The electronic devices 240 can be part of an LED driver 260 supplying several LED lighting module 270. The first pair of pins 210 is connected to the first contact 110 of the disconnector 100 via a circuit board 200. The disconnector 100 is also firmly attached to the circuit board 250. The second contact 120 of the disconnector 100 is connected to the electronic devices 240 via the circuit board 240. The end cap 225 has an opening 285 for inserting the separator plate 140 for disconnecting the first contact 110 from second contact 120.

Figure 6:
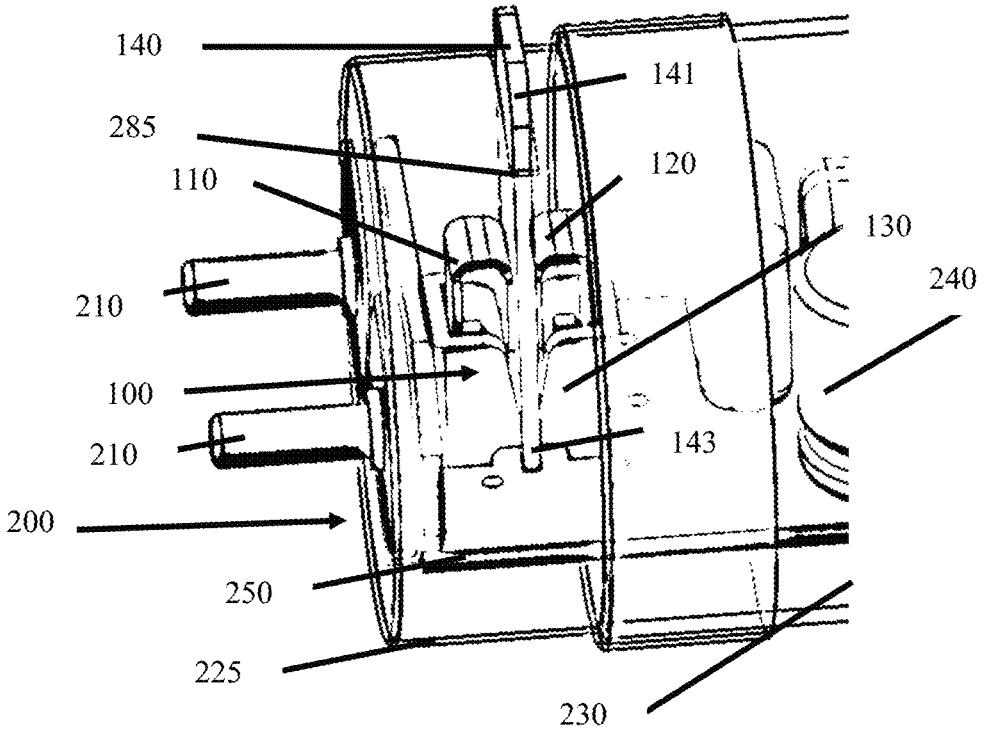
FIG. 6 shows a perspective view of a first embodiment of the disconnector in a not closed condition with the separator plate used in a LED lamp.

FIG. 6 is a sectional view of a LED lamp 200 in an electrically disconnected condition. The separator plate 140 is placed between the first contact 110 and the second contact 120 of the disconnector 100 and disconnects the electric path between the first pair of pins 210 and the electronic devices 240 via the disconnector 100. The insertion depth of the separator plate 140 is limited by the support 130 of the disconnector 100. The size of the opening 285 of the end cap 225 corresponds to the size of the bottom part 143 of the separation plate 140 such the insertion depth of the separation plate 140 is limited by the protrusions 142 of the separation plate.

Figure 7:
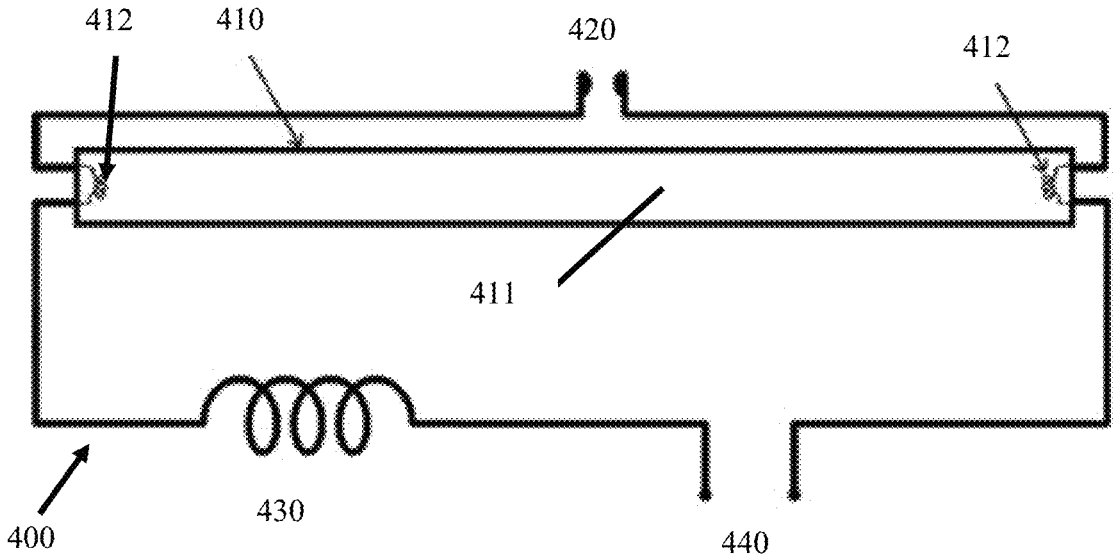
FIG. 7 shows a circuit diagram of a conventional fluorescence tube respectively a LED lamp within the lamp holder.

FIG. 7 shows a schematic layout of a conventional lighting device 400 comprising a fluorescence tube 410 having a glass tube 411 and a pair of hot cathodes 412 at each end of the fluorescence tube 410 for heating the gas into the glass tube 411. The lighting device 400 further comprises a starter 420 and a load 430 for generating a voltage pulse for starting the fluorescence tube 410. The lighting device 400 is usually connected to an AC power supply 440 providing the supply voltage.

Figure 8:
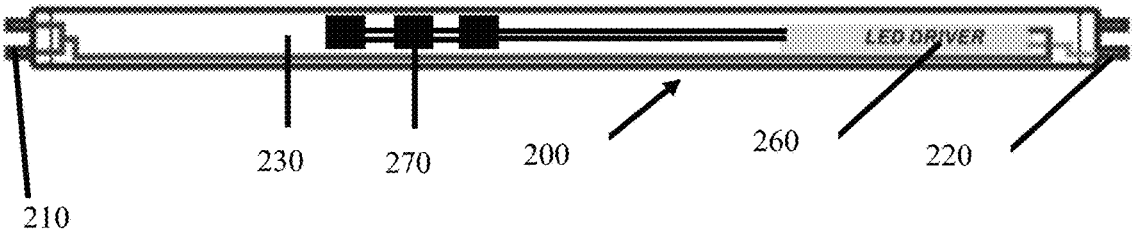
FIG. 8 shows a schematic diagram of a LED lamp.

FIG. 8 shows a schematic layout of a LED lamp 200. The LED lamp 200 may comprise a first pair of pins 210 and a second pair of pins 220 as standard interface for supplying the LED lamp 200 with power. The LED lamp 200 may further comprise an LED driver 260 for supplying several LED lighting module 270 with energy and rectifying the AC supply voltage 440. The LED driver 260 is connected to the first pair of pins 210 and to the second pair of pins 220.

Figure 9:
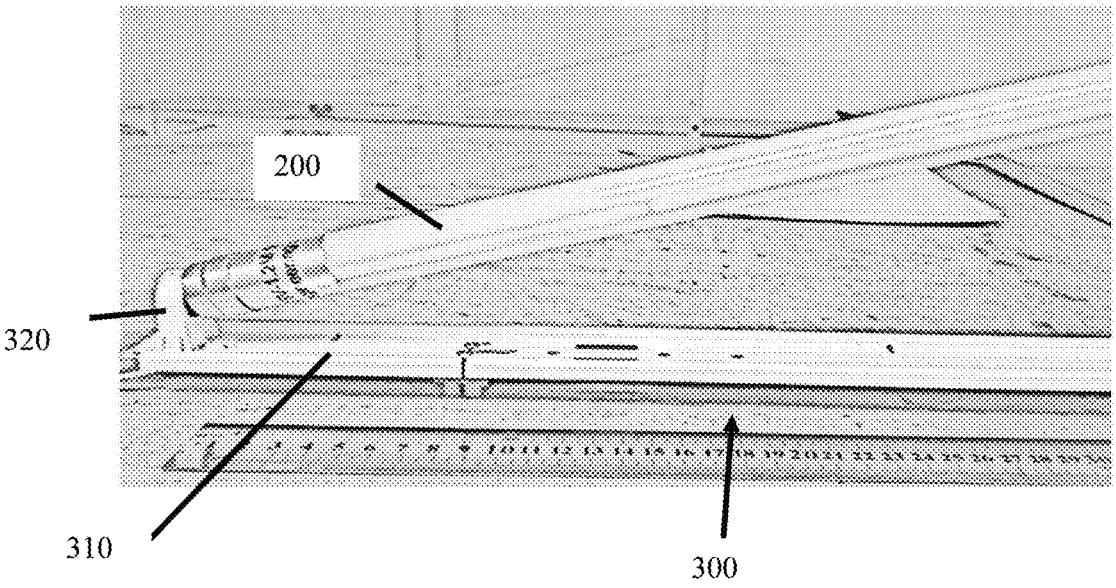
FIG. 9 shows a perspective view of a luminaire housing with a LED lamp.

FIG. 9 shows a conventional lighting device according to FIG. 5 with a lamp holder 300 comprising a base 300 as assembly plate with a pair of tube holders 320 (only one shown). The LED lamp 200 according to FIG. 6 is connected with one end and respectively the first pair of pins 210 to the tube holder 320. Thus, the free second pair of pins 220 is energized via the LED driver 260 and an electric shock can occur.

Although the invention has been illustrated and described in detail by the embodiments explained above, it is not limited to these embodiments. Other variations may be derived by the skilled person without leaving the scope of the attached claims.

Generally, "a" or "an" may be understood as singular or plural, in particular with the meaning "at least one", "one or more", etc., unless this is explicitly excluded, for example by the term "exactly one", etc.

In addition, numerical values may include the exact value as well as a usual tolerance interval, unless this is explicitly excluded.

Features shown in the embodiments, in particular in different embodiments, may be combined or substituted without leaving the scope of the invention.

LIST OF REFERENCE NUMERALS

100 Disconnector
110 First contact
111 Contact point
115 Contact base
117 Bending portion
120 Second contact
121 Contact point
125 Contact base
126 Protrusion
130 Support, Mounting bracket
135 Seat
140 Separator plate
141 Upper part
142 Protrusion
143 Bottom part
144 Longitudinal side
145 Wide side
200 LED lamp
210 First pair of pins
220 Second pair of pins
225 End cap
230 Tube
240 Electronic devices
250 Circuit board
260 LED driver
270 LED lighting module
280 End cap
285 Opening
300 Luminaire housing
310 Base
320 Tube holder
400 Conventional lighting device
410 Fluorescent tube
411 Glass tube
412 Hot cathode
420 Starter
430 Load
440 AC power supply

The invention claimed is:

1. A light-emitting diode (LED) lamp for use in a fluorescent tube luminaire housing, the LED lamp comprising:
- a transparent tube including an LED lighting module;
- a first contact pin at a first end of the tube and a second contact pin at a second end of the tube for connecting the LED lamp electrically and mechanically to the luminaire housing, wherein the first contact pin and the second contact pin form an electric circuit with an LED driver for driving the LED lighting module; and
- a disconnector arranged in the electric circuit between the first contact pin and the second contact pin for electrically disconnecting the first contact pin from the second contact pin during installation of the LED lamp, wherein the disconnector comprises:
  - a first electrical contact configured to be in electrical connection with the first contact pin; and
  - a second electrical contact configured to be in electrical connection with the second contact pin;
  - wherein the disconnector is configured to have an isolating separator plate placed between the first electrical contact and the second electrical contact so as to electrically disconnect the first contact pin from the second contact pin.

2. The LED lamp according to claim 1, wherein the LED lamp further comprises a circuit board, wherein the disconnector is firmly attached to the circuit board.

3. The LED lamp according to claim 2, wherein the disconnector is fixedly mounted to the circuit board.

4. The LED lamp according to claim 2, wherein the disconnector further comprises an isolating support body configured to support the first electrical contact and the second electrical contact such that the first electrical contact and the second electrical contact are physically biased into contact with one another, wherein the isolating support body is fixedly mounted to the circuit board.

5. The LED lamp according to claim 1, wherein:
- each of the first and second electrical contacts has a first end with a base contact and a second end with a contact point for electrically connecting the first electrical contact to the second electrical contact; and
- the disconnector further comprises an isolating support for supporting the first electrical contact and the second electrical contact such that the first electrical contact is in contact with the second electrical contact at the contact points in a mechanically pre-loaded condition to connect the electric circuit electrically.

6. The LED lamp according to claim 5, wherein the second end of the contacts has a "u" shape with a bending portion for generating a spring force.

7. The LED lamp according to claim 5, wherein the isolating support has a cube shape with an additional seat for the separator plate for separating the first electrical contact and the second electrical contact to disconnect the electric circuit.

8. The LED lamp according to claim 1, wherein the first electrical contact and the second electrical contact are both flexible spring contacts.

9. A method for replacing a conventional fluorescent tube by an LED lamp according to claim 1, the method comprising:

removing the conventional fluorescent tube from a fluorescent tube luminaire housing;

inserting the LED lamp with a first contact pin at a first end of the tube to a first tube holder and with a second contact pin at a second end of the tube to a second tube holder; and connecting the electrical circuitry between the first contact pin and the second contact pin by closing the disconnector after insertion of the LED lamp into the first and second tube holders.

10. The LED lamp according to claim 1, wherein:

the first electrical contact is configured to be biased into contact against a first face of the separator plate; and the second electrical contact is configured to be biased into contact against a second face of the separator plate, the second face opposing the first face.

11. The LED lamp according to claim 1, wherein the separator plate is removable from being in place between the first electrical contact and the second electrical contact.

12. The LED lamp according to claim 1, wherein:

the first contact pin is configured to electrically connect with the first electrical contact;

the first electrical contact is configured to electrically connect, in turn, with the second electrical contact; and the second electrical contact is configured to electrically connect, in turn, with the second contact pin.

13. The LED lamp according to claim 1, wherein in being configured to have the separator plate placed between the first electrical contact and the second electrical contact so as to electrically disconnect the first contact pin from the second contact pin, the disconnector is configured to have the separator plate physically intervene between the first electrical contact and the second electrical contact, breaking physical contact and electrical connection between the first electrical contact and the second electrical contact.

14. The LED lamp according to claim 1, wherein the first electrical contact is positioned more proximal to the first contact pin than the second electrical contact along a longitudinal length of the LED lamp.

15. The LED lamp according to claim 1, wherein the first electrical contact and the second electrical contact are configured to pinch the separator plate therebetween.

16. A light-emitting diode (LED) lamp for use in a fluorescent tube luminaire housing, the LED lamp comprising:

a transparent tube including an LED lighting module;

a first contact pin at a first end of the tube and a second contact pin at a second end of the tube for connecting the LED lamp electrically and mechanically to the luminaire housing, wherein the first contact pin and the second contact pin form an electric circuit with an LED driver for driving the LED lighting module; and a disconnector arranged in the electric circuit between the first contact pin and the second contact pin for disconnecting the first contact pin from the second contact pin during installation of the LED lamp, wherein the disconnector comprises a first electrical contact in connection with the first contact pin and a second electrical contact in connection with the second contact pin, wherein an isolating separator plate for separating the first electrical contact and the second electrical contact by placing the separator plate between the first electrical contact and the second electrical contact for disconnecting the first contact pin from the second contact pin is provided, characterized in that the separator plate has an approximately rectangular shape with an upper part as a holder for gripping the separator plate by hand, a bottom part for separating the first electrical contact from the second electrical contact by tensioning the bottom part tensioned between the first electrical contact and the second electrical contact of the disconnector to separate the first electrical contact from the second electrical contact.

17. The LED lamp according to claim 16, wherein the separator plate has two additional protrusions for limiting the insertion depth of the separator plate.

18. The LED lamp according to claim 17, characterized in that the size of the opening of the end cap corresponds to the size of the bottom part of the separator plate, wherein the insertion depth of the separator plate is limited by the protrusions.

19. A light-emitting diode (LED) lamp for use in a fluorescent tube luminaire housing, the LED lamp comprising:

a transparent tube including an LED lighting module;

a first contact pin at a first end of the tube and a second contact pin at a second end of the tube for connecting the LED lamp electrically and mechanically to the luminaire housing, wherein the first contact pin and the second contact pin form an electric circuit with an LED driver for driving the LED lighting module; and a disconnector arranged in the electric circuit between the first contact pin and the second contact pin for disconnecting the first contact pin from the second contact pin during installation of the LED lamp, wherein the disconnector comprises a first electrical contact in connection with the first contact pin and a second electrical contact in connection with the second contact pin, wherein an isolating separator plate for separating the first electrical contact and the second electrical contact by placing the separator plate between the first electrical contact and the second electrical contact for disconnecting the first contact pin from the second contact pin is provided;

wherein at least one of the first contact pin and the second contact pin is supported by an end cap of the LED lamp, and the end cap has an opening for inserting or removing the separator plate.

20. The LED lamp according to claim 19, characterized in that the size of the opening of the end cap corresponds to the size of a bottom part of the separator plate, and wherein the insertion depth of the separator plate is limited by protrusions of the separator plate.

* * * * *